US009370790B2

(12) United States Patent
Kim et al.

(10) Patent No.: US 9,370,790 B2
(45) Date of Patent: Jun. 21, 2016

(54) SHOCK-ABSORBING LOWER STRUCTURE OF AN AIRLESS TYPE DISPENSER

(71) Applicant: YONWOO CO., LTD., Incheon (KR)

(72) Inventors: Hak-Chan Kim, Incheon (KR); Sung-Woo Cheon, Incheon (KR); Shin-Bok Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/419,419

(22) PCT Filed: Oct. 29, 2012

(86) PCT No.: PCT/KR2012/008924

§ 371 (c)(1),
(2) Date: Feb. 3, 2015

(87) PCT Pub. No.: WO2014/021505

PCT Pub. Date: Feb. 6, 2014

(65) Prior Publication Data

US 2015/0217313 A1 Aug. 6, 2015

(30) Foreign Application Priority Data

Aug. 3, 2012 (KR) ..... 10-2012-0085043

(51) Int. Cl.
*B65D 88/54* (2006.01)
*B05B 11/00* (2006.01)

(52) U.S. Cl.
CPC ..... *B05B 11/0048* (2013.01); *B05B 11/3001* (2013.01); *B05B 11/0037* (2013.01)

(58) Field of Classification Search
CPC B65D 83/0033; B05B 11/02; B05B 11/0048; B05B 11/3001; B05B 11/0037
USPC ..... 222/320, 386, 387, 256, 321.7–321.9
See application file for complete search history.

(56) References Cited

U.S. PATENT DOCUMENTS 2,625,302 A * 1/1953 Mahoney ..... A47K 5/18 222/173
3,377,003 A * 4/1968 Bacon ..... B65D 83/64 221/227

(Continued)

FOREIGN PATENT DOCUMENTS

JP 2006-123913 A 5/2006
JP 2007-153416 A 6/2007

(Continued)

OTHER PUBLICATIONS

International Search Report issued in PCT/KR2012/008924 dated Feb. 26, 2013.

*Primary Examiner* — Lien Ngo
(74) *Attorney, Agent, or Firm* — Marshall, Gerstein & Borun LLP

(57) ABSTRACT

The present invention relates to a shock-absorbing lower structure of an airless type dispenser, wherein a support member made of elastic material is arranged in a lower part of a piston to provide a cushioning function so as to support the lower end of the piston in the housing of the dispenser. Thus, when the piston descends and presses a housing support by the shock applied from an external source, the housing support is prevented from being separated from the housing of the dispenser. Furthermore, when content expand in volume at a low temperature, not only is a housing support or a pumping member prevented from being separated, but also the pumping member is prevented from being damaged.

1 Claim, 5 Drawing Sheets

(56) References Cited

U.S. PATENT DOCUMENTS 3,421,664 A * 1/1969 Eichberg ..... B65D 83/64
222/227
3,870,200 A * 3/1975 Spatz ..... B65D 83/0033
222/206
2008/0210711 A1* 9/2008 Riesle ..... B65D 83/0038
222/153.13
2013/0140332 A1* 6/2013 Csaszar ..... B05B 11/0048
222/256

FOREIGN PATENT DOCUMENTS

KR 2010-0095545 A 8/2010
KR 2011-002076 A 3/2011

* cited by examiner

SHOCK-ABSORBING LOWER STRUCTURE OF AN AIRLESS TYPE DISPENSER

CROSS-REFERENCE TO RELATED APPLICATIONS

This U.S. non-provisional patent application claims the benefit of priority under 35 U.S.C. §119 of Korean Patent Application No. 10-2012-0085043, filed Aug. 3, 2012, the entire content of which is hereby incorporated by reference for all purposes.

TECHNOLOGICAL FIELD

The present invention relates to a shock-absorbing lower structure of an airless type dispenser.

BACKGROUND OF THE INVENTION

Generally, airless type dispensers are containers which are used to discharge viscos-type contents quantitatively, comprising a main storage holding contents and a temporary storage. As for the operational principle, when a pressing device of an airless type dispenser is pressed, the contents held in the temporary storage is discharged to the outside, and then when released, the pressing device is lifted towards upwards by an elastic member like a spring, as the pressure in the temporary storage is decreasing and at the same time the contents held in the main storage is moving to the temporary storage, and then the piston inside the housing moves to upwards.

Airless type dispensers are used in popularity for storing cosmetics and pharmaceutical products for the advantage in that an airless type dispenser can discharge small amount of contents quantitatively, and since air does not influx into the inside, it can store contents for a long period time without being spoiled.

Airless type dispensers are usually made of aluminum, laminate, or synthetic resin depending on contents to be stored, but usually synthetic resin is used when it comes to ordinary cosmetic containers.

This synthetic resin has advantages of being light-weighted, inexpensive to be manufactured, and easy to be molded. However, there are disadvantages that it can be easily broken by the external shock when an airless type dispenser is dropped on the floor or while it is carried inside the bag, and in particular by the second shock that occurs when a piston is lowered by the external force, a housing support may be separated from a housing. In addition, it also has problem that when the airless type dispenser is filled with contents and maintained at a low temperature, the contents may be frozen and expand in volume, pressurizing the housing support located at the lower part of the airless type dispenser and then resulting in the housing support of the airless type dispenser being separated from the housing.

SUMMARY OF THE DISCLOSURE

The present document describes embodiments that solve the said problems above, and its goal is to provide a shock-absorbing lower structure of an airless type dispenser, wherein a support member made of elastic material is arranged in a lower part of a piston to provide a cushioning function so as to support the lower end of the piston in the housing of the dispenser. Thus, when the piston descends and presses a housing support by the shock applied from an external source, the housing support is prevented from being separated from the housing of the dispenser. Furthermore, when content expand in volume at a low temperature, not only is the housing support or a pumping member prevented from separating, but also the pumping member is prevented from being damaged.

To solve the problems above, according to the present description, a shock-absorbing lower structure of an airless type dispenser comprises a housing which contains contents and involves a piston that rises upward according to the use of contents on the inner lower part, wherein a shock-absorbing lower structure of an airless type dispenser is featured with a support member located on the lower part of the piston and made of elastic material which supports the piston to be able to absorb shock.

In addition, a shock-absorbing lower structure of an airless type dispenser comprises a housing containing contents and involving a piston that rises upwards according to the use of the contents on the inner lower part, and a pumping member engaged on the upper part of the housing and discharging the contents to the outside, wherein a shock-absorbing lower structure of an airless type dispenser is featured with a buffer part that is located on the lower part of the piston and secures empty space from the top surface of a housing support to the fixed height.

In addition, it is featured that the said support member extends from the lower end of the housing support that is engaged to the lower part of the housing, and supports the lower end of the piston.

In addition, it is featured that the said support member is made of metal or soft synthetic resin.

In addition, it is featured that the said support comprises a securing part that is secured on the lower part of the housing; an elastic part that extends from the securing part to the upper part, made of elastic material to be able to contract and relax; and a support part that is located on the end of the elastic part and supports the lower end of the piston.

In addition, it is featured that a protrusion is formed on the inner lower part so as to prevent the securing part from moving upwards.

Described as above, the present document describes embodiments which include a support member made of elastic material on the lower part of a piston, so as to support the lower end of a piston inside the housing, and provides cushioning function, wherein when the piston descends and presses a housing support, the housing support is prevented from being separated from the housing, and when contents expands in volume at a low temperature, not only is the housing support or the pumping member prevented from being separated, but also the pumping member is prevented from being damaged.

DETAILED DESCRIPTION

Figure 1:
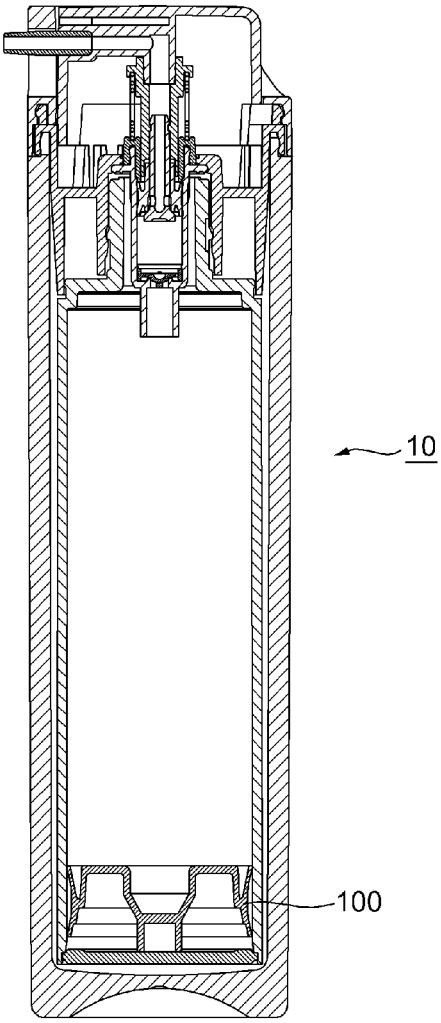
FIG. 1 is an assembled cross-sectional view illustrating a configuration of an existing airless type dispenser.

Hereinafter, exemplary embodiments will be described in detail with reference to the accompanying drawings. The same reference numerals provided in the drawings indicate the same members.

Figure 2:
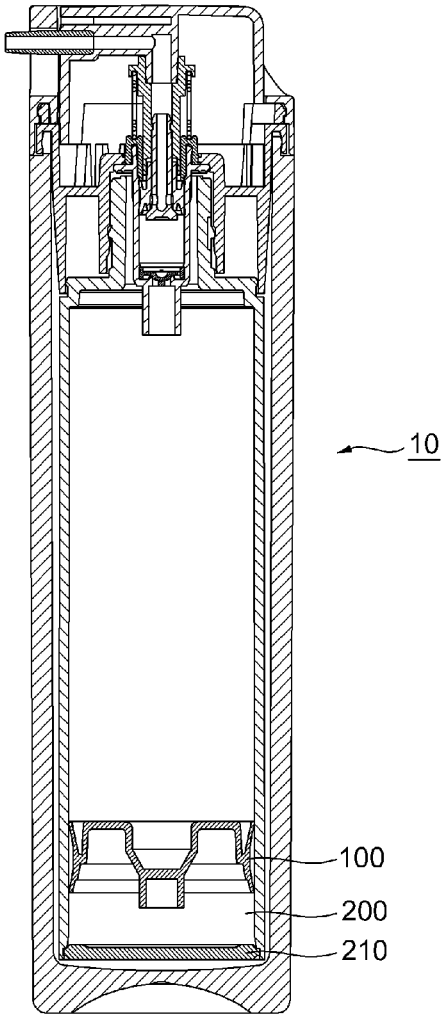
FIG. 2 is an assembled cross-sectional view illustrating a configuration of an airless type dispenser with shock-absorbing function according to an first exemplary embodiment of the present invention.
Figure 3:
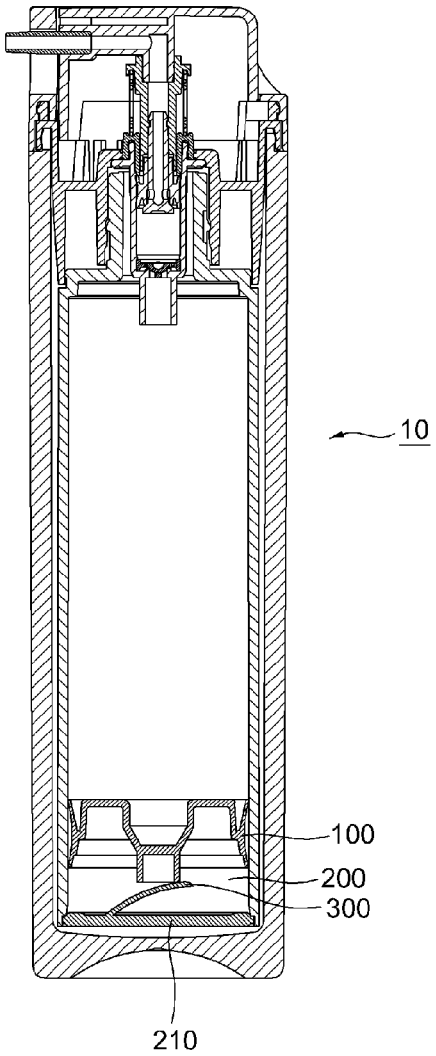
FIG. 3 is an assembled cross-sectional view illustrating a configuration of an airless type dispenser with shock-absorbing function according to an second exemplary embodiment of the present invention.
Figure 4:
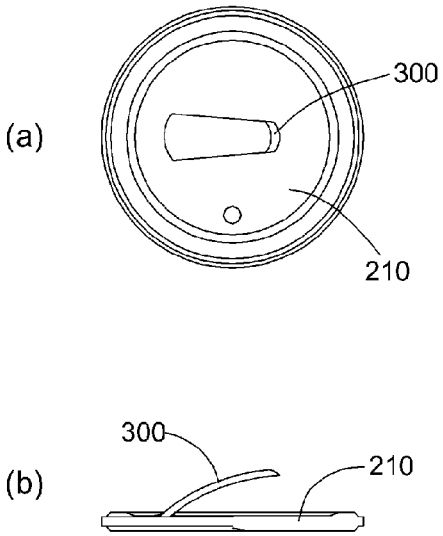
FIG. 4 is an explanatory view illustrating a configuration of a support member comprising the lower part of a shock-absorbing lower structure of an airless type dispenser according to a second exemplary embodiment of the present invention.

FIG. 2 is an assembled cross-sectional view illustrating a configuration of an airless type dispenser a shock-absorbing function according to an first exemplary embodiment of the present description; FIG. 3 is an assembled cross-sectional view illustrating a configuration of an airless type dispenser with a shock-absorbing function according to an second exemplary embodiment of the present description; and FIG. 4 is an explanatory view illustrating a configuration of a support member comprising an airless type dispenser with a shock-absorbing function according to a second exemplary embodiment of the present description.

Referring to FIG. 2, an airless type dispenser according to a first exemplary embodiment of the present description includes a piston 100, and a buffer part 200.

After discharging contents to the outside from a housing 10, the said piston 100 makes the height of the contents ascend and get close to a discharging part, by the inner pressure difference of a housing 10.

Meanwhile, the buffer part 200 is located on the lower part of the piston 100 and is composed to secure empty space from the upper surface of a housing support 210 to the fixed height, wherein the buffer part 200 forms empty space between the piston 100 and the housing support 210 and makes the piston 100 separated by a small margin from the housing support 210; therefore, the housing support 210 is prevented from being separated from the housing 10 by the shock that is formed when the housing 10 is dropped to the floor or by the shock from the outside while the housing is carried.

Referring FIG. 3, an airless type dispenser according to a second exemplary embodiment of the present description is preferred to comprise a piston 100, a buffer part 200, and also a housing support 300.

The said support member 300 is located on the lower part of the piston 100 and made of elastic material to support the piston 100. In other words, when the support member 300 is dropped onto the floor, though the piston 100 descends, the support member 300 will not collide with the housing support 210 directly, instead absorbing the shock with elastic material, and then preventing the housing support 210 from being separated from the housing 10.

Meanwhile, the support member 300 is located on the lower part of the piston 100 and also inside the buffer part 200 so as to be able to secure empty space from the upper surface of the housing support 210 to the fixed height, wherein it is featured that the support member 300 extends upwards from a point of the upper surface of the housing support 210 to the fixed height and supports the lower end of the piston 100.

In particular, as shown in FIGS. 4*a* and 4*b*, it is preferred that the support member 300 should extend from a point of the housing support 210 to the fixed height, forming a curve, for the reason that the curved shape of the upper part absorbs the shock that is delivered to the housing support 210 when a dispenser is dropped and the piston 100 descends.

In addition, it is preferred that the lower structure of the airless type dispenser should be built, with the height of the piston 100 reduced as much as the height of the support member 300. It is because, by reducing as much height of the piston 100 as the height of the support member 300, the airless type dispenser with shock-absorbing function can also be filled with the same amount of contents as an existing airless type dispenser.

Meanwhile, it is preferred that the support member 300 should be made of metal or soft synthetic resin for a shock absorbing function. The usable material is a metal that has elasticity, in particular stainless steel or more specifically poly-propylene such as soft synthetic resin.

Figure 5:
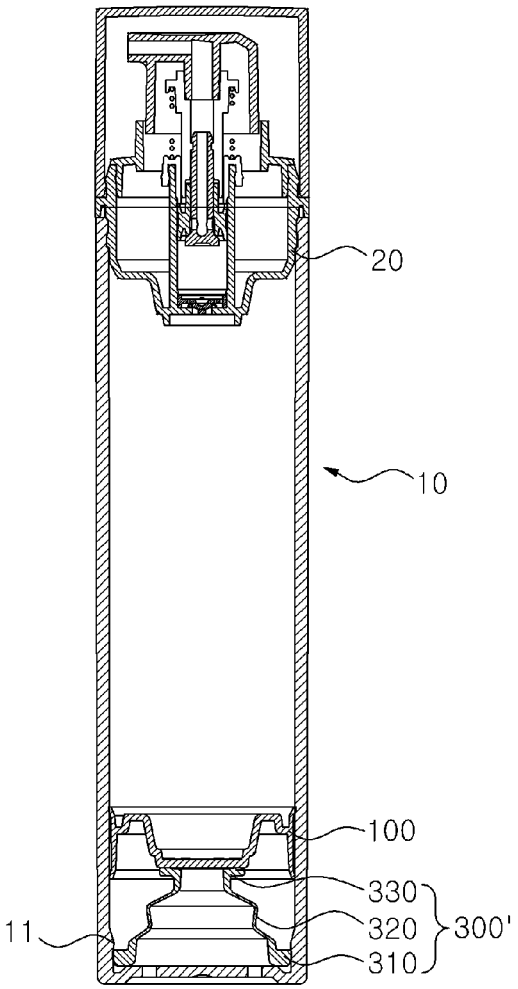
FIGS. 5 and 6 is an assembled cross-sectional view illustrating a configuration of an airless type dispenser with shock-absorbing function according to a third exemplary embodiment of the present invention.
Figure 6:
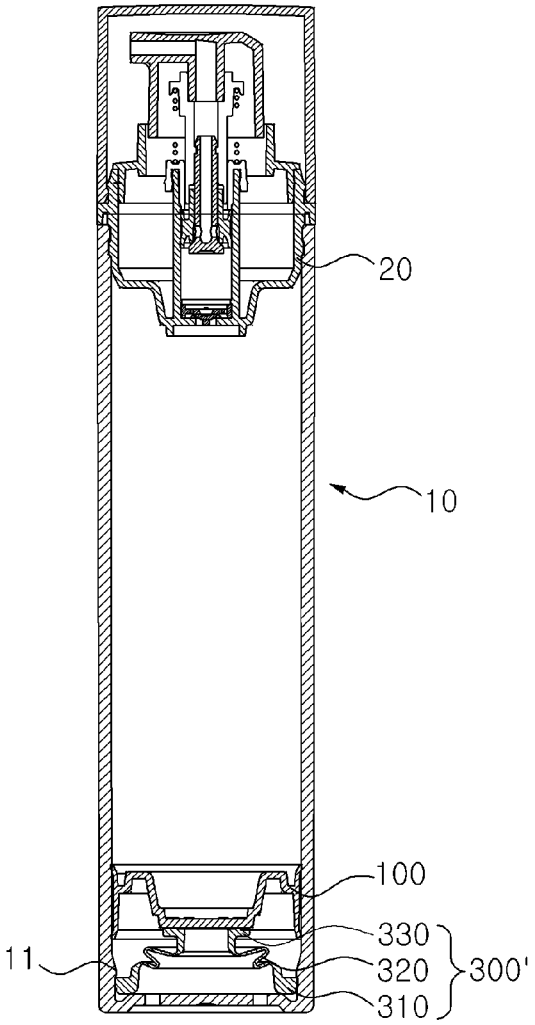
Figure 7:
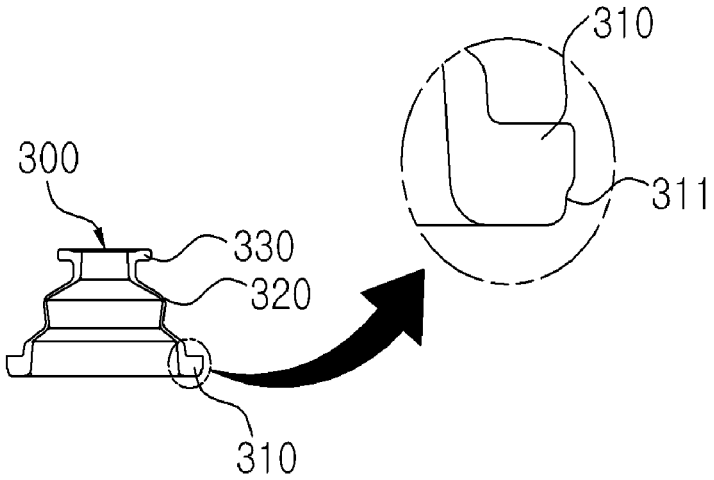
FIG. 7 is an explanatory view illustrating a configuration of a support member comprising the lower part of a shock-absorbing lower structure of an airless type dispenser according to a third exemplary embodiment of the present invention.

Hereinafter, an airless type dispenser with a shock-absorbing function according to a third exemplary embodiment of the present description will be described in detail with reference to the accompanying drawings FIGS. 5 to 7. FIGS. 5 and 6 are assembled cross-sectional views illustrating a configuration of an airless type dispenser with a shock-absorbing function according to a third exemplary embodiment of the present description, and FIG. 7 is an explanatory view illustrating a configuration of a support member comprising the lower part of a shock-absorbing lower structure of an airless type dispenser according to a third exemplary embodiment of the present description.

Referring FIG. 5 to 7, a shock-absorbing lower structure of an airless type dispenser according to a third exemplary embodiment of the present description is formed, with the end part of the housing 10 closed, without a separated support on the end of the housing 10, wherein if formed into an all-in-one without a support, an airless type dispenser may be frozen under the below zero temperature while being carried and as a result, a pumping member 20 engaged on the upper part of the housing 10 may be separated from the housing 10 by the expansion of the contents; however, as for the third exemplary embodiment of the present description, a support member 300 made of elastic material is installed on the lower part of the piston 100 so as to prevent the pumping member 20 from being separated.

The said support member 300, which is installed inside of the piston 100 in the housing 10 and supports the end of the piston 100, comprises a securing part 310 that is secured on the inner bottom surface of the housing 10; an elastic part 320 that extends from the securing part 10 to the upper part and is composed of corrugated elastic material to be able to contract/relax; and an support part 330 that is located at the end of the elastic part 320 and supports the lower end of the piston 100.

The said elastic part 320, as shown in FIG. 5, stays relaxed in the normal state. However, when the piston 100 is descended by the volume expansion of the contents and pressurization occurs, the elastic part 320, as shown in FIG. 6, contracts and absorbs the shock from the piston 100, and thus absorb the relative impact to the pumping member 20, then preventing the pumping member 20 from be separated from the housing 10.

Meanwhile, it is preferred that a protrusion 11 is engaged on the inner lower part of the housing 10, encircling inner circumference, in order to prevent the securing part from moving upwards.

In addition, it is preferred that when installing a support member 300' to inner bottom surface of the housing 10, a gradual inclined surface 311 is formed on the lower part of the outer circumference of the securing part 310 so that the interference by the said protrusion may not arise.

Preferred embodiments of the present description are described in more detail with reference to the accompanied drawings. The present inventions may, however, be embodied in different forms and should not be constructed as limited to the embodiments set forth herein. Rather, these embodiments are provided so that this disclosure will be thorough and complete, and will fully convey the scope of the present description to those skilled in the art.

What is claimed is:

1. A shock-absorbing lower structure of an airless type dispenser comprising:

a housing containing contents and including a piston moving upwards according to a use of contents; and a pumping member engaged to the upper part of the housing and discharging contents by pumping action, wherein a shock-absorbing lower structure of an airless type dispenser further comprising a support member, located on the lower part of the piston and made of an elastic material that supports the piston so as to make an absorbing shock effect possible, the support member extending from a point of an upper surface of a housing support coupled to a lower portion of the housing, the support member having a curved upper side, and wherein the support member is separated from a lower end of the piston when the piston ascends and the support member supports the lower end of the piston when the piston descends as a result of an external impact, thereby preventing the housing support from being separated from the housing.

* * * * *